US010527976B2

(12) United States Patent
Kinoshita

(10) Patent No.: US 10,527,976 B2
(45) Date of Patent: Jan. 7, 2020

(54) TONER SUPPLY DEVICE AND IMAGE FORMING APPARATUS

(71) Applicant: Konica Minolta, Inc., Chiyoda-ku, Tokyo (JP)

(72) Inventor: Takeru Kinoshita, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/160,529

(22) Filed: Oct. 15, 2018

(65) Prior Publication Data

US 2019/0163096 A1 May 30, 2019

(30) Foreign Application Priority Data

Nov. 27, 2017 (JP) ..... 2017-227109

(51) Int. Cl.
*G03G 15/16* (2006.01)
*G03G 15/08* (2006.01)

(52) U.S. Cl.
CPC ..... *G03G 15/165* (2013.01); *G03G 15/0808* (2013.01)

(58) Field of Classification Search
CPC ..... G03G 15/165; G03G 15/0808; G03G 21/1821; G03G 21/1842
See application file for complete search history.

(56) References Cited

U.S. PATENT DOCUMENTS

2018/0356763 A1* 12/2018 Ding ..... G03G 21/1647

FOREIGN PATENT DOCUMENTS

JP 2005-134452 5/2005

* cited by examiner

*Primary Examiner* — David M. Gray
*Assistant Examiner* — Andrew V Do
(74) *Attorney, Agent, or Firm* — Squire Patton Boggs (US) LLP

(57) ABSTRACT

A toner supply device includes a pressing portion that presses a toner cartridge such that the toner cartridge is detached from a device body. The toner cartridge has an engaging portion. The device body has a guiding portion. The guiding portion has an upper guide groove that guides the engaging portion in an attachment operation of attaching the toner cartridge to the device body, and a lock portion provided at a position deviated from the upper guide groove in an innermost portion of the guiding portion. When the engaging portion moving in the upper guide groove along with the attachment operation reaches the innermost portion, the engaging portion is engaged with the lock portion by the pressing portion pressing back the toner cartridge, allowing the toner cartridge to be attached to the device body so as not to be detached therefrom.

8 Claims, 12 Drawing Sheets

TONER SUPPLY DEVICE AND IMAGE FORMING APPARATUS

Japanese Patent Application No. 2017-227109 filed on Nov. 27, 2017 including description, claims, drawings, and abstract the entire disclosure is incorporated herein by reference in its entirety.

BACKGROUND

Technological Field

The present disclosure relates to a toner supply device and an image forming apparatus.

Description of the Related Art

A toner supply device for use in an electrophotographic image forming apparatus includes a supply device body that allows a toner-containing toner cartridge to be attached thereto and detached therefrom, a toner supply port through which toner is supplied from the toner cartridge, a supply port shutter that opens and closes the toner supply port, and a toner conveyor that conveys toner supplied from the toner cartridge to a developing device.

Japanese Laid-Open Patent Publication No. 2005-134452 discloses a toner supply device configured such that when a toner cartridge is detached, a cartridge-side engaging member provided in the toner cartridge and a shutter-side engaging member provided integrally with a supply port shutter are engaged with each other to move the supply port shutter from an open position to a closed position and, when the supply port shutter moves to the closed position, the shutter-side engaging member elastically deforms to be disengaged from the cartridge-side engaging member.

SUMMARY

The configuration described in the above literature causes a heavy operational feeling due to a resistance generated when the shutter-side engaging member elastically deforms, or causes an impact when the elastic deformation is released, which does not allow for a smooth operational feeling.

The present disclosure provides a toner supply device having an improved operational feeling and an image forming apparatus including the toner supply device.

To achieve at least one of the abovementioned objects, according to an aspect of the present invention, a toner supply device reflecting one aspect of the present invention comprises a toner cartridge, a device body, and a pressing portion. The toner cartridge contains toner. The device body allows the toner cartridge to be attached thereto and detached therefrom. The pressing portion presses the toner cartridge such that the toner cartridge is detached from the device body. One of the toner cartridge and the device body has an engaging portion, and the other of the toner cartridge and the device body has a guiding portion. The guiding portion guides the engaging portion in an attachment operation of attaching the toner cartridge to the device body and a detachment operation of detaching the toner cartridge from the device body. The guiding portion has an attachment path and a lock portion. The attachment path extends in a moving direction of the toner cartridge and guides the engaging portion in the attachment operation. The lock portion is provided at a position deviated from the attachment path in an innermost portion of the guiding portion. When the engaging portion moving in the attachment path along with the attachment operation reaches the innermost portion, the engaging portion is engaged with the lock portion by the pressing portion pressing back the toner cartridge, allowing the toner cartridge to be attached to the device body so as not to be detached therefrom.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Embodiment according to the present, invention will be described with reference to the drawings. In the following description, the same components and constitutional elements are denoted by the same references, which applies to their names and functions. Detailed descriptions thereof will thus not be repeated.

[Image Forming Apparatus 100]

Figure 1:
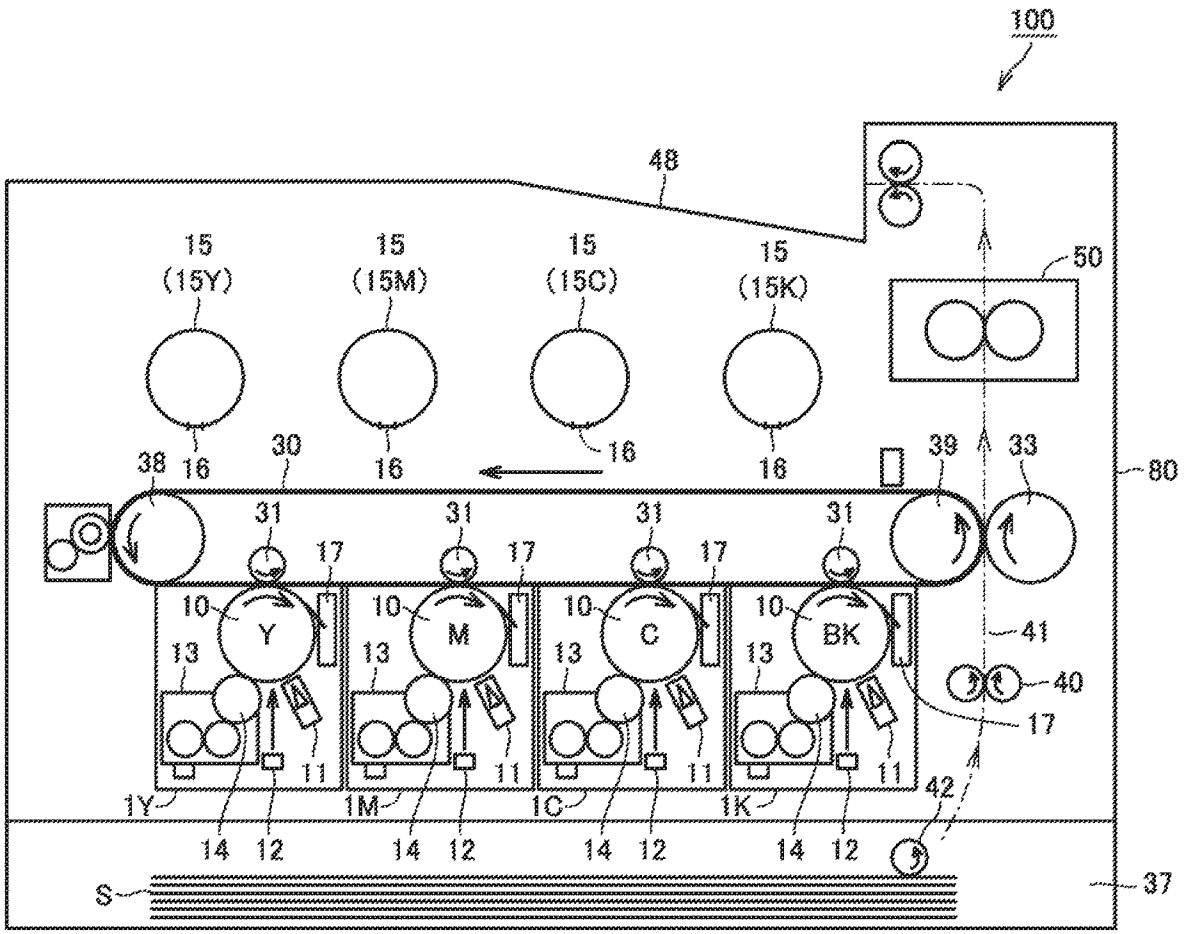
FIG. 1 is a schematic view of an image forming apparatus according to an embodiment.

FIG. 1 is a schematic view of an image forming apparatus 100 according to an embodiment. FIG. 1 shows image forming apparatus 100 serving as a color printer. Although description will be given below with regard to the color printer, image forming apparatus 100 is not limited to the color printer. For example, image forming apparatus 100 may be a monochrome printer, a facsimile machine, or a multi-functional peripheral (MFP) including a monochrome printer, a color printer, and a facsimile machine.

Image forming apparatus 100 mainly includes image forming units 1Y, 1M, 1C, and 1K, an intermediate transfer belt 30. primary transfer rollers 31, a secondary transfer roller 33, a cassette 37, a driven roller 38, a driving roller 39, a timing roller 40, a fixing device 50, and a housing 80.

Housing 80 defines the outer shell of image forming apparatus 100. Housing 80 accommodates image forming units 1Y, 1M, 1C, and 1K, intermediate transfer belt 30, primary transfer rollers 31, secondary transfer roller 33, cassette 37, driven roller 38, driving roller 39, timing roller 40, and fixing device 50.

Image forming units 1Y, 1M, 1C, and 1K, intermediate transfer belt 30, primary transfer rollers 31. secondary transfer roller 33, cassette 37, driven roller 38, driving roller 39, and timing roller 40 constitute an image forming device. This image forming device forms a toner image on a sheet S serving as a recording medium transported along a transport path 41, which will be described below.

Image forming unite 1Y, 1M, 1C, and 1K are arranged in order along intermediate transfer belt 30. Image forming unit 1Y is supplied with toner from a toner cartridge 15Y to form a yellow (Y) toner image. Image forming unit 1M is supplied with toner from a toner cartridge 15M to form a magenta (M) toner image. Image forming unit 1C is supplied with toner from a toner cartridge 15C to form a cyan (C) toner image, image forming unit 1K is supplied with toner from a toner cartridge 15K to form a black (BK) toner image.

Image forming units 1Y, 1M, 1C, and 1K are disposed in order in the direction of rotation of intermediate transfer belt 30 along intermediate transfer belt 30. Image forming units 1Y, 1M, 1C, and 1K each include a photoconductor 10, a charging device 11, an exposing device 12, a developing device 13, and a cleaning device 17.

Charging device 11 charges the surface of photoconductor 10 uniformly. Exposing device 12 irradiates photoconductor 10 with laser light, thereby exposing the surface of photoconductor 10 to light in accordance with an input image pattern. An electrostatic latent image corresponding to the input image is thus formed on photoconductor 10.

Developing device 13 applies a developing bias to a developing roller 14 while rotating developing roller 14, thus causing the toner to adhere to the surface of developing roller 14. Consequently, the toner is transferred from developing roller 14 to photoconductor 10, so that a toner image corresponding to the electrostatic latent image is developed on the surface of photoconductor 10. Photoconductor 10 has the function of serving as an image carrier that carries a toner image on the surface thereof.

Photoconductor 10 and intermediate transfer belt 30 are in contact with each other at a portion at which primary transfer roller 31 is provided. Primary transfer roller 31 has a roller shape and is configured rotatably. A transfer voltage of the polarity opposite to that of the toner image is applied to primary transfer roller 31, causing the toner image to be transferred from photoconductor 10 to intermediate transfer belt 30. A yellow (Y) toner image, a magenta (M) toner image, a cyan (C) toner image, and a black (BK) toner image are overlaid in order and transferred from photoconductor 10 onto intermediate transfer belt 30. Consequently, a color toner image is formed on intermediate transfer belt 30.

Intermediate transfer belt 30 is laid across driven roller 38 and driving roller 39. Driving roller 39 is drivingly rotated by, for example, a motor (not shown). Intermediate transfer belt 30 and driven roller 38 rotate along with driving roller 39. Consequently, the totter image on intermediate transfer belt 30 is transported to secondary transfer roller 33.

Cleaning device 17 is pressed against photoconductor 10. Cleaning device 17 collects the toner remaining on the surface of photoconductor 10 after the transfer of the toner image.

Sheets S are set in cassette 37. Sheets S are fed one by one front cassette 37 by a pickup roller 42 and are sent to secondary transfer roller 33 along transport path 41 by timing roller 40.

Secondary transfer roller 33 has a roller shape and is configured rotatably. Secondary transfer roller 33 applies a transfer voltage of the polarity opposite to that of the toner image to sheet S being transported. This causes the toner image to be attracted from intermediate transfer belt 30 to secondary transfer roller 33, so that the toner image on intermediate transfer belt 30 is transferred. A timing at which sheet S is transported to secondary transfer roller 33 is adjusted by timing roller 40 in accordance with the position of the toner image on intermediate transfer belt 30. Timing roller 40 allows the toner image on intermediate transfer belt 30 to be transferred to an appropriate position of sheet S.

Fixing device 50 pressurizes and heats sheet S passing therethrough. The toner image is accordingly fixed onto sheet S. Fixing device 50 fixes the toner image on sheet S transported along transport path 41. Sheet S with the toner image fixed thereon is ejected to a tray 48.

Although image forming apparatus 100 adopting a tandem method as a printing method has been described above, the printing method of image forming apparatus 100 is not limited to the tandem method. The arrangement of the components in image forming apparatus 100 can be changed appropriately in accordance with the printing method adopted. The printing method of image forming apparatus 100 may be a rotary method or a direct transfer method. In the case of the rotary method, image forming apparatus 100 is composed of one photoconductor 10, and a plurality of developing devices 13 configured to be rotatable on the same axis. In printing, image forming apparatus 100 guides developing devices 13 sequentially to photoconductor 10 to develop toner images of the respective colors. In the case of the direct transfer method, image forming apparatus 100 directly transfers the toner image formed on photoconductor 10 to sheet S.

[Toner Supply Device 60]

Figure 2:
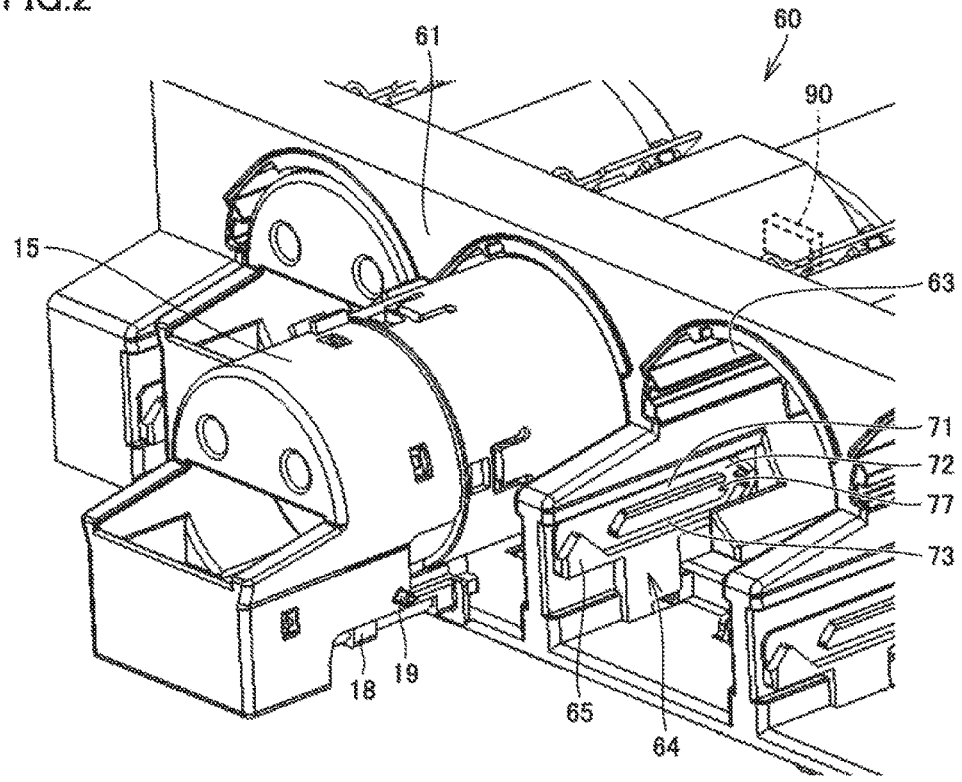
FIG. 2 is a perspective view showing a schematic configuration of a toner supply device according to the embodiment.
Figure 3:
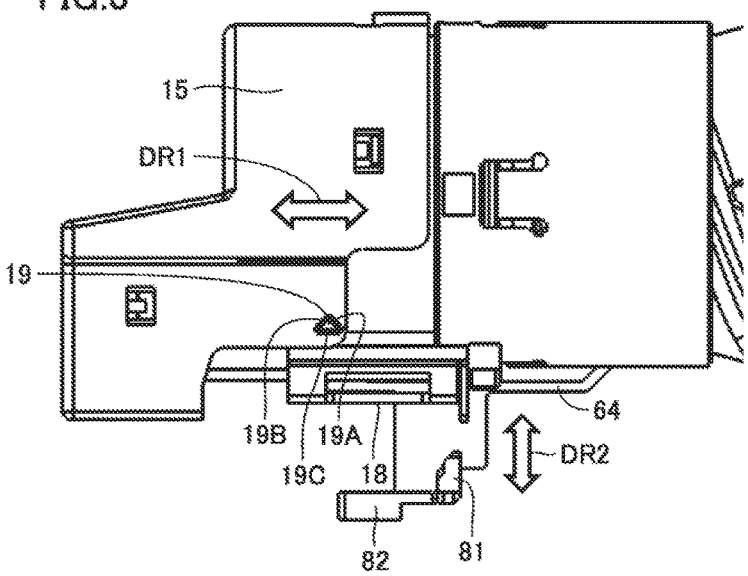
FIG. 3 is a side view of a toner cartridge.
Figure 4:
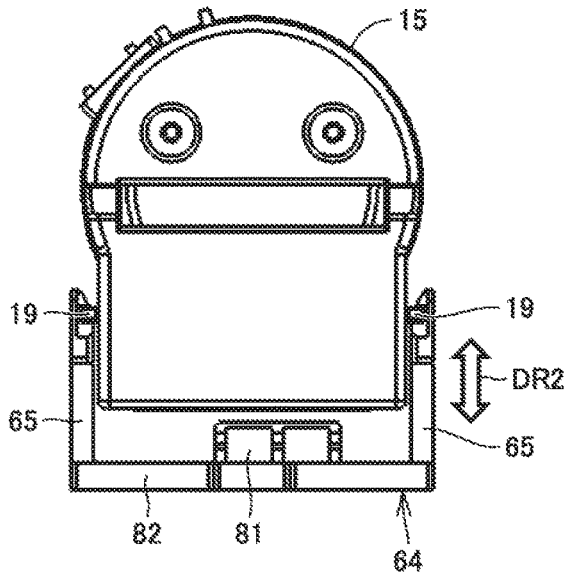
FIG. 4 is a front view of the toner cartridge.

FIG. 2 is a perspective view showing a schematic configuration of a toner supply device 60 according to the embodiment. Toner supply device 60 includes toner cartridges 15Y, 15M, 15C, and 15K described above (which will be collectively referred to as toner cartridge 15 below), and a device body 61. FIG. 3 is a side view of toner cartridge 15. FIG. 4 is a front view of toner cartridge 15.

Toner cartridge 15 is configured to be attachable to and detachable from device body 61. Device body 61 has a plurality of (in the present embodiment, four) hollow accommodating spaces 63 formed for accommodating toner cartridges 15. A moving direction DR1 indicated by a double-pointed arrow in FIG. 3 is a direction in which toner cartridge 15 moves with respect to device body 61 when toner cartridge 15 is attached to device body 61 or when toner cartridge 15 is detached from device body 61. When the floor or desk on which image forming apparatus 100 is placed is horizontal, moving direction DR1 extends horizontally.

Toner cartridge 15 contains toner of each color. As shown in FIG. 1, a toner supply port 16 is formed in each toner cartridge 15. Toner supply port 16 is formed in the lower surface of toner cartridge 15. The toner contained in toner cartridge 15 is discharged from toner supply port 16 out of toner cartridge 15, and passes through a toner supply path (not shown) to be supplied to developing device 13 (FIG. 1) of each of image forming units 1Y, 1M, 1C, and 1K.

Toner cartridge 15 has a shutter 18 that opens and closes toner supply port 16. Shutter 18 is configured to be movable relative to the body of toner cartridge 15. While toner cartridge 15 is detached from device body 61. shutter 18 is disposed at a position for closing toner supply port 16. Shutter 18 shown in FIGS. 2 and 3 covers toner supply port 16 from below.

Toner cartridge 15 has an engaging portion 19 projecting from a side surface of toner cartridge 15. Engaging portion 19 shown in FIG. 3 as viewed laterally has a triangular shape. Typically, engaging portion 19 as viewed laterally has an isosceles triangle shape, and the base of the isosceles triangle extends in moving direction DR1 of toner cartridge 15. Engaging portion 19 has a front inclined surface 19A, a rear inclined surface 19B, and a bottom surface 19C. Front inclined surface 19A and bottom surface 19C form a wedge shape forming one base angle of the isosceles triangle. Rear inclined surface 19B and bottom surface 19C form a wedge shape forming the other base angle of the isosceles triangle.

As shown in FIG. 4, a pair of engaging portions 19 are provided in side portions on the opposite sides of toner cartridge 15. A first engaging portion 19 projects from one side surface of toner cartridge 15, and a second engaging portion 19 projects from the other side surface of toner cartridge 15. The direction in which first engaging portion 19 projects from toner cartridge 15 and the direction in which second engaging portion 19 projects from toner cartridge 15 are opposite to each other.

Toner supply device 60 also includes a pressing portion 90 as shown in FIG. 2. Pressing portion 90 is exposed to accommodating space 63 of device body 61. Pressing portion 90 presses toner cartridge 15 attached to device body 61 such that toner cartridge 15 is detached from device body 61. Pressing portion 90 is disposed in the innermost portion of accommodating space 63. Pressing portion 90 includes, for example, a spring member. The spring member is an example of a biasing portion that biases toner cartridge 15 such that toner cartridge comes out of device body 61. The spring member disposed in the innermost portion of accommodating space 63 deforms upon receipt of a stress from toner cartridge 15 inserted into accommodating space 63, allowing elastic energy to be accumulated in the spring member. Consequently, a force of pressing back toner cartridge 15 acts.

The spring member may have any shape such as that of a blade spring or a coil spring. The biasing portion does not necessarily need to be disposed in the innermost portion of accommodating space 63 and may be disposed partway along accommodating space 63. The biasing portion is not limited to a spring member and may be a member made of rubber material or polymeric material. Pressing portion 90 is not limited to have a configuration that biases toner cartridge 15 by elastic energy. Pressing portion 90 may be configured such that an actuator that generates driving force is provided and toner cartridge 15 is pressed to be detached from device body 61 by the driving force generated by the actuator.

Figure 5:
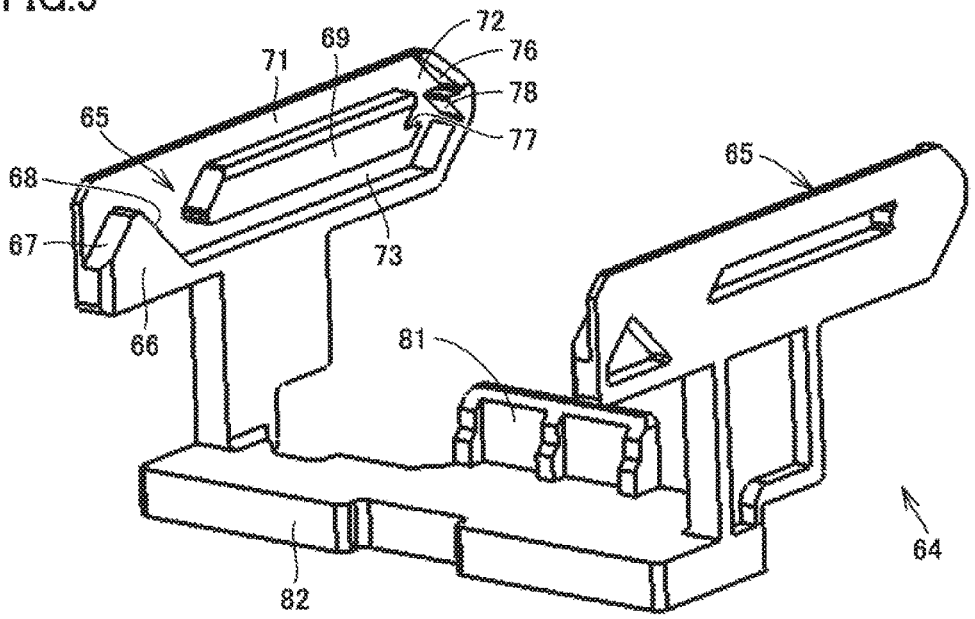
FIG. 5 is a perspective view of an engaging member.

Toner supply device 60 also includes an engaging member 64. Engaging member 64 of the embodiment is provided in device body 61. FIG. 5 is a perspective view of engaging member 64.

Engaging member 64 has a pair of guiding portions 65, a regulating portion 81, and a connecting portion 82. As shown in FIG. 4, the pair of guiding portions 65 are provided in the side portions on the opposite sides of toner cartridge 15. A first guiding portion 65 is disposed facing one side surface of toner cartridge 15. A second guiding portion 65 is disposed facing the other side surface of toner cartridge 15. The pair of guiding portions 65 are formed bilaterally symmetric with each other.

Regulating portion 81 and connecting portion 82 are disposed below toner cartridge 15. Connecting portion 82 connects the pair of guiding portions 65 to regulating portion 81. Connecting the pair of guiding portions 65 to regulating portion 81 by connecting portion 82 provides engaging member 64 having an integral structure. Guiding portions 65 and regulating portion 81 project upward from connecting portion 82. Regulating portion 81 projects from connecting portion 82 toward the lower surface of toner cartridge 15. As shown in FIG. 3, regulating portion 81 projects toward shutter 18.

Engaging member 64 is configured to be integrally movable. Guiding portions 65 and regulating portion 81 move together. An up-down direction DR2 indicated by a double-pointed arrow in FIGS. 3 and 4 indicates a direction in which engaging member 64 moves relative to toner cartridge 15. Up-down direction DR2 is orthogonal to moving direction DR1. When the floor or desk on which image forming apparatus 100 is placed is horizontal, up-down direction DR2 extends vertically.

Toner cartridge 15 is configured to move in moving direction DR1 and not to move in up-down direction DR2. Engaging member 64 is configured to move in up-down direction DR2 and not to move in moving direction DR1.

As shown in FIGS. 2 and 5, guiding portion 65 has an upper guide groove 71 and a lower guide groove 73. Guiding portion 65 has a separate protrusion 69. Separate protrusion 69 separates upper guide groove 71 and lower guide groove 73 from each other in up-down direction DR2. Lower guide groove 73 is formed below upper guide groove 71. Upper guide groove 71 and lower guide groove 73 extend linearly in moving direction DR1 of toner cartridge 15.

Guiding portion 65 has an entrance/exit inclined portion 66. Entrance/exit inclined portion 66 is provided at a position that forms an entrance or exit of a path of engaging portion 19 that moves relative to guiding portion 65. Entrance/exit inclined portion 66 has an entrance inclined surface 67 and an exit inclined surface 68. As engaging portion 19 moves toward upper guide groove 71 along entrance inclined surface 67, engaging member 64 moves down. As engaging portion 19 moves away from lower guide groove 73 along exit inclined surface 68, engaging member 64 moves down.

Guiding portion 65 guides engaging portion 19 in the operation of attaching and detaching toner cartridge 15 to and from device body 61. In an attachment operation of attaching toner cartridge 15 to device body 61, for engaging portion 19 to move along entrance inclined surface 67 of entrance/exit inclined portion 66 and then move within upper guide groove 71, toner cartridge 15 moves in moving direction DR1, and engaging member 64 moves in up-down direction DR2. In a detachment operation of detaching toner cartridge 15 from device body 61, for engaging portion 19 to move within lower guide groove 73 and then move along exit inclined surface 68 of entrance/exit inclined portion 66, toner cartridge 15 moves in moving direction DR1, and engaging member 64 moves in up-down direction DR2.

Guiding portion 65 has an innermost portion 72. Innermost, portion 72 is provided at an innermost position in a path of engaging portion 19 that moves relative to guiding portion 65. A loop path including upper guide groove 71 and lower guide groove 73 is formed in guiding portion 65, and innermost portion 72 forms a folded-back portion of the loop path. In the operation of attaching and detaching toner cartridge 15 to and from, device body 61, engaging portion 19 moves relative to guiding portion 65 along the loop path. Upper guide groove 71 forms an inward route of the loop path, and lower guide groove 73 forms an outward route of the loop path.

Guiding portion 65 has an upper receiving portion 76, a lock portion 77, and a lower receiving portion 78 in innermost portion 72. Upper guide groove 71, upper receiving portion 76, lock portion 77, lower receiving portion 78, and lower guide groove 73 are disposed in the stated order front top to bottom in up-down direction DR2. Lock portion 77 is disposed below upper guide groove 71. Lock portion 77 is disposed at a position deviated front upper guide groove 71. Lower guide groove 73 is disposed below lock portion 77. Lock portion 77 is disposed at a position deviated from lower guide groove 73.

Upper receiving portion 76 is provided on the inner side with respect to the path through which engaging portion 19 moves with respect to guiding portion 65. Lock portion 77 is provided on the front side with respect to the path through which engaging portion 19 moves with respect to guiding portion 65. Lower receiving portion 78 is provided on the inner side with respect to the path through which engaging portion 19 moves with respect to guiding portion 65. Engaging portion 19 that moves from upper guide groove 71 via upper receiving portion 76, lock portion 77, and lower receiving portion 78 to lower guide groove 73 moves in a zigzag manner through a path formed in a sawtooth shape.

Figure 6:
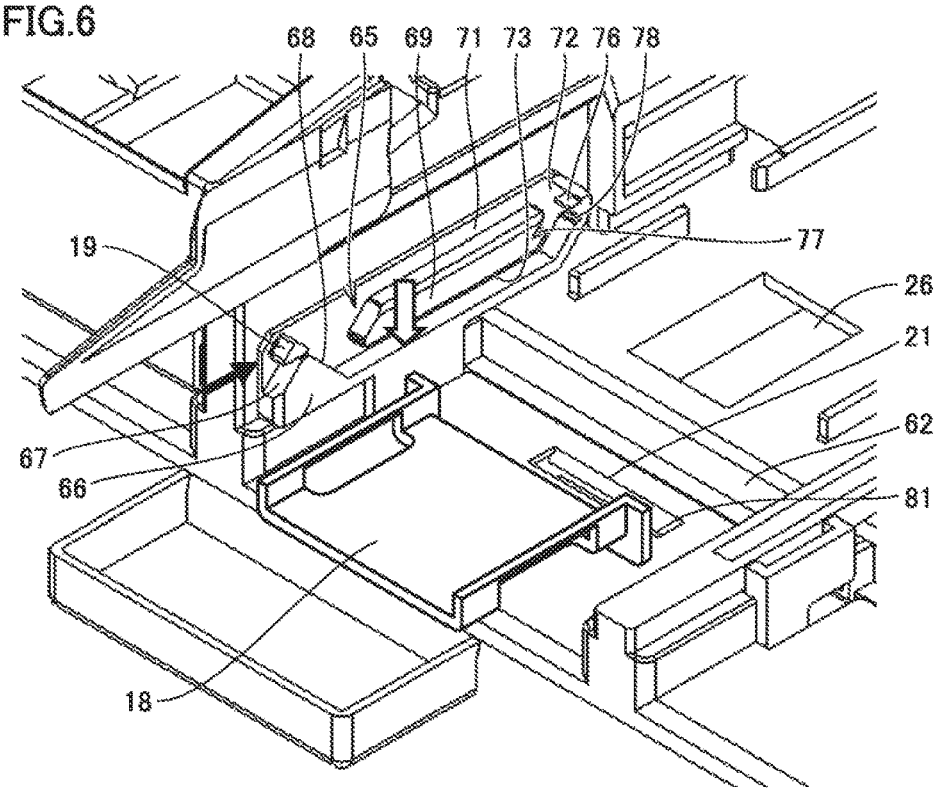
FIG. 6 is a perspective view showing a first step of an attachment operation of attaching the toner cartridge to a device body.

FIG. 6 is a perspective view showing a first step of the attachment operation of attaching toner cartridge 15 to device body 61. In FIG. 6 and the following figures, shutter 18 and engaging portion 19 in the configuration of toner cartridge 15 are shown, and the body of toner cartridge 15 is not shown. As shown in FIG. 6, device body 61 has an abutment portion 62. Abutment portion 62 has a wall shape that crosses, typically, is orthogonal to moving direction DR1 and extends in up-down direction DR2, typically, parallel to up-down direction DR2. Abutment portion 62 forms a step on the floor of device body 61. The floor of device body 61 on the front side with respect to abutment portion 62 is formed to be lower by one step than the floor of device body 61 on the inner side with respect to abutment portion 62.

An opening 21 is formed on the front side with respect to abutment portion 62. As described below in detail, regulating portion 81 of engaging member 64 can project upward from opening 21 or can be disposed below opening 21. A reception opening 26 is formed on the inner side with respect to abutment portion 62. Reception opening 26 is an opening for receiving toner discharged from toner supply port 16 (FIG. 1) and forms an entrance of a toner supply path that guides toner to developing device 13.

[Operation of Attaching and Detaching Toner Cartridge 15]

The following will describe an operation of attaching and detaching toner cartridge 15 to and from device body 61 in toner supply device 60 configured as described above. In the following figures, a solid arrow indicates the movement of engaging portion 19, and an open arrow indicates the movement of guiding portion 65. Regulating portion 81 moves together with guiding: portion 65 in the direction indicated by the open arrow.

In the attachment operation of attaching toner cartridge 15 to device body 61, toner cartridge 15 is first pressed into accommodating space 63 (FIG. 2) of device body 61, causing engaging portion 19 to abut against entrance inclined surface 67 of entrance/exit, inclined portion 66. Engaging portion 19 moves relative to guiding portion 65 along entrance inclined surface 67, allowing guiding portion 65 to move down as indicated by the open arrow in FIG. 6. Regulating portion 81 moves down together with guiding portion 65 to be disposed below opening 21. Regulating portion 81 is disposed at such a position as not to interfere with the movement of shutter 18 toward the inner side of device body 61.

If engaging member 64 is disposed at a lowest portion in a movable range of engaging member 64 by the action in the last operation of detaching toner cartridge 15 or under its own weight, engaging portion 19 may pass above entrance inclined surface 67, allowing engaging portion 19 to move without abutting against entrance inclined surface 67.

Figure 7:
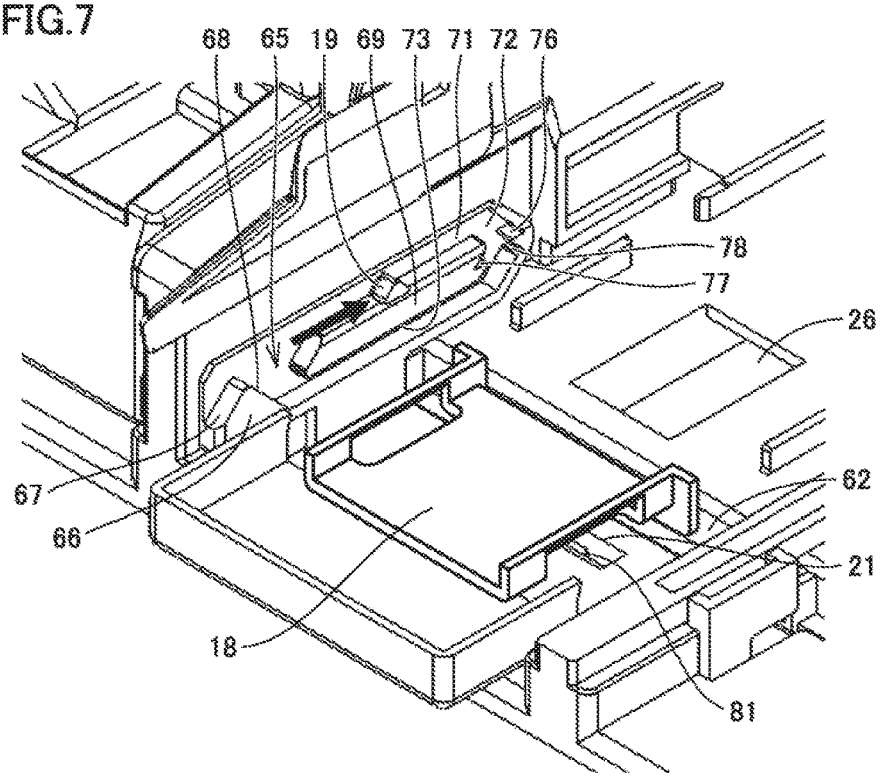
FIG. 7 is a perspective view showing a second step of the attachment operation.
Figure 8:
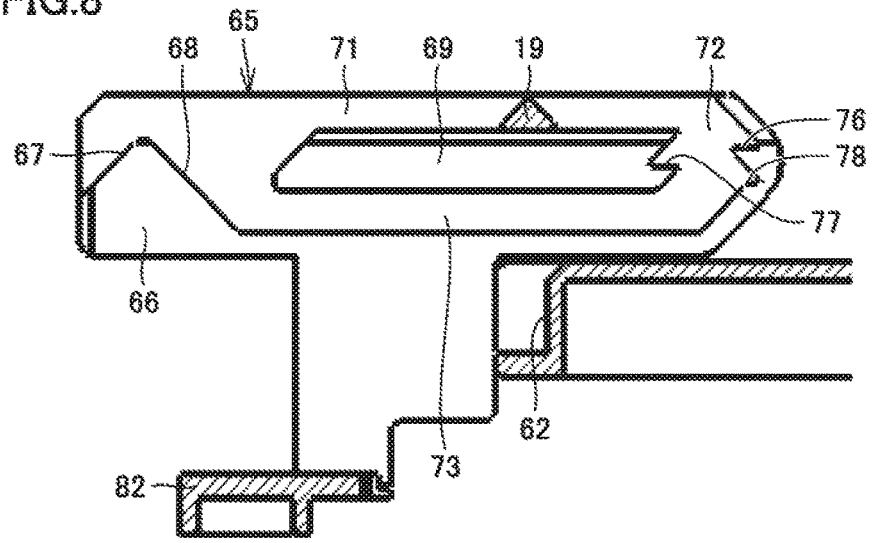
FIG. 8 is a schematic view of an engaging portion and a guiding portion shown in FIG. 7 as viewed laterally.

FIG. 7 is a perspective view showing a second step of the attachment operation. FIG. 8 is a schematic view of engaging portion 19 and guiding portion 65 shown in FIG. 7 as viewed laterally. In the second step of the attachment operation, engaging portion 19 moves toward the inner side of device body 61, toward innermost portion 72 within upper guide groove 71. Since the relative positions of engaging portion 19 and guiding portion 65 in up-down direction DR2 do not change while engaging portion 19 is moving within upper guide groove 71 after crossing entrance/exit inclined portion 66, engaging member 64 does not move in up-down direction DR2.

As shown in FIG. 7, shutter 18 abuts against abutment portion 62 while engaging portion 19 is moving within upper guide groove 71. When toner cartridge 15 continues moving toward the inner side of device body 61 in moving direction DR1, abutment portion 62 interferes with tire movement of shutter 18. Shutter 18 accordingly does not move together with toner cartridge 15, allowing shutter 18 to move relative to toner supply port 16 formed in toner cartridge 15. Consequently, toner supply port 16 is opened, so that shutter 18 does not cover toner supply port 16.

Figure 9:
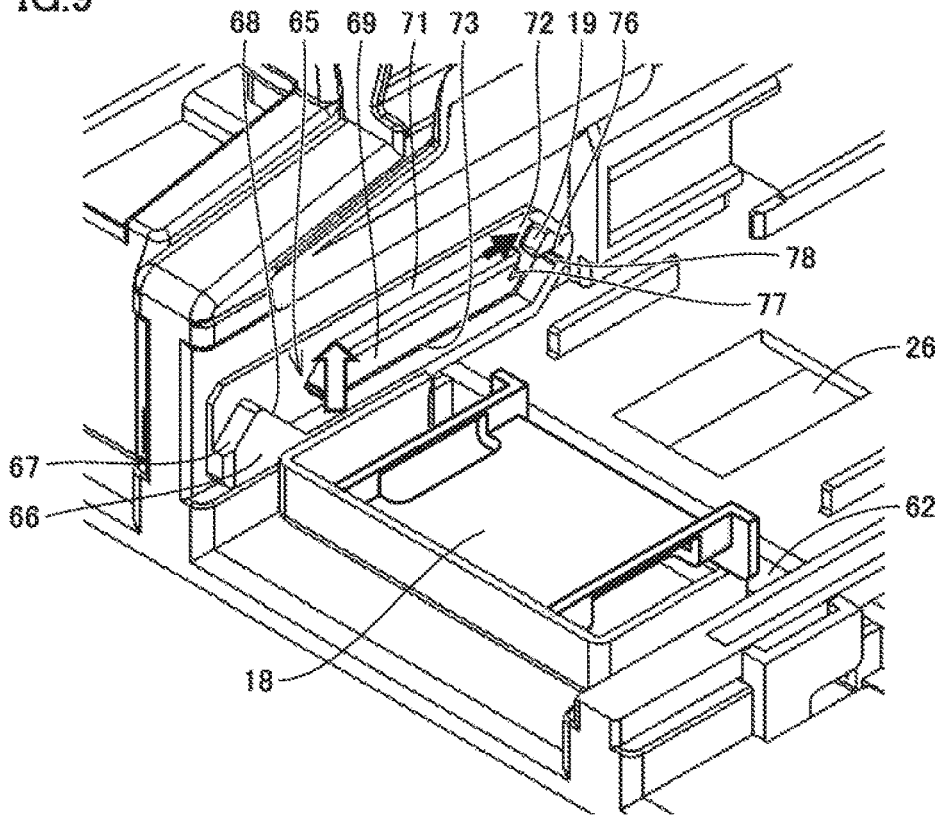
FIG. 9 is a perspective view showing a third step of the attachment operation.
Figure 10:
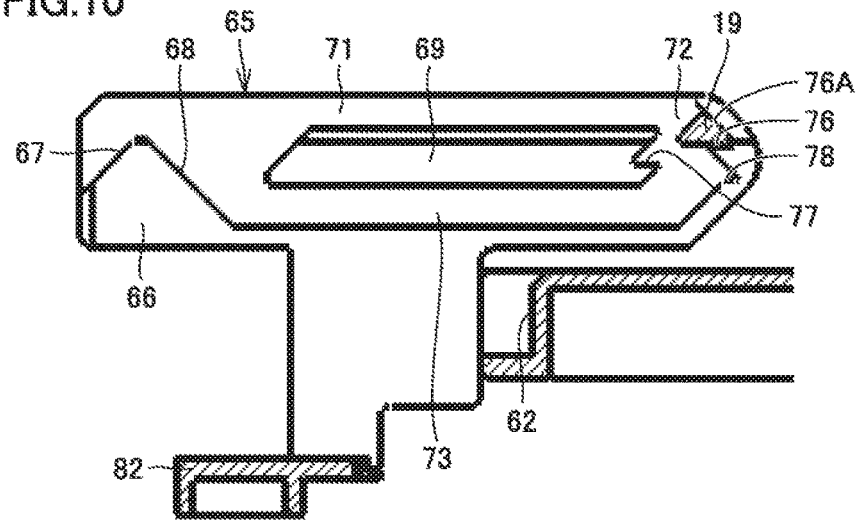
FIG. 10 is a schematic view of the engaging portion and the guiding portion shown in FIG. 9 as viewed laterally.

FIG. 9 is a perspective view showing a third step of the attachment operation. FIG. 10 is a schematic view of engaging portion 19 and guiding portion 65 shown in FIG. 9 as viewed laterally. In the third step of the attachment operation, engaging portion 19 reaches innermost portion 72. Front inclined surface 19A (FIG. 3) of engaging portion 19 abuts against an upper inclined surface 76A (FIG. 10). Engaging portion 19 further moves along upper inclined surface 76A to be engaged with upper receiving portion 76, Since upper receiving portion 76 is disposed below upper guide groove 71, guiding portion 65 moves up as indicated by the open arrow in FIG. 9. Regulating portion 81 moves up together with guiding portion 65.

Figure 11:
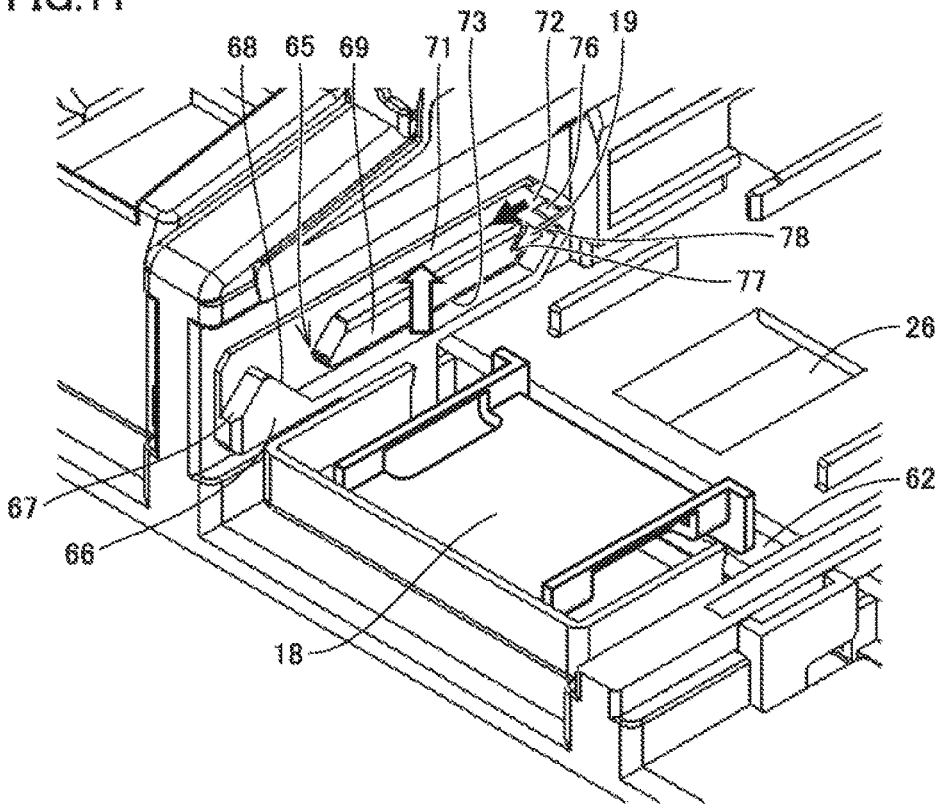
FIG. 11 is a perspective view showing a state in which the engaging portion is engaged with a lock portion.
Figure 12:
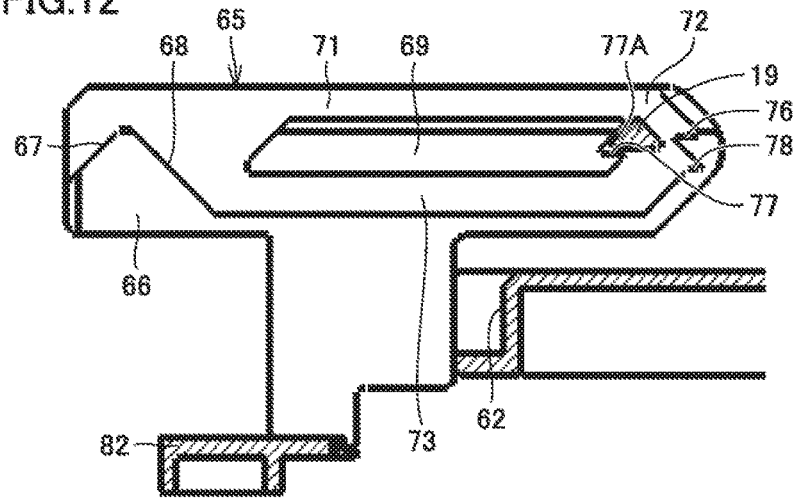
FIG. 12 is a schematic view of the engaging portion and the guiding portion shown in FIG. 11 as viewed laterally.

FIG. 11 is a perspective view showing a state in which engaging portion 19 is engaged with lock portion 77. FIG. 12 is a schematic view of engaging portion 19 and guiding portion 65 shown in FIG. 11 as viewed laterally. Toner cartridge 15 is pressed back by pressing portion 90 from the state in which engaging portion 19 is engaged with upper receiving portion 76 as shown in FIGS. 9 and 10, allowing toner cartridge 15 to move toward the front side of device body 61. This movement allows rear inclined surface 198 (FIG. 3) of engaging portion 19 to abut against a lock inclined surface 77A (FIG. 12). Engaging portion 19 moves along lock inclined surface 77A. Then, as shown in FIGS. 11 and 12. engaging portion 19 is engaged with lock portion 77, allowing toner cartridge 15 to be attached to device body 61 so as not to be detached therefrom.

At this time, toner supply port 16 of toner cartridge 15 is disposed at a position facing reception opening 26. Toner supply port 16 is not covered with shutter 18 and is open. Toner cartridge 15 is positioned at a position suitable for toner supply.

Since lock portion 77 is disposed below upper receiving portion 76, guiding portion 65 moves up as indicated by the open arrow in FIG. 11. Regulating portion 81 moves tip together with guiding portion 65.

Figure 13:
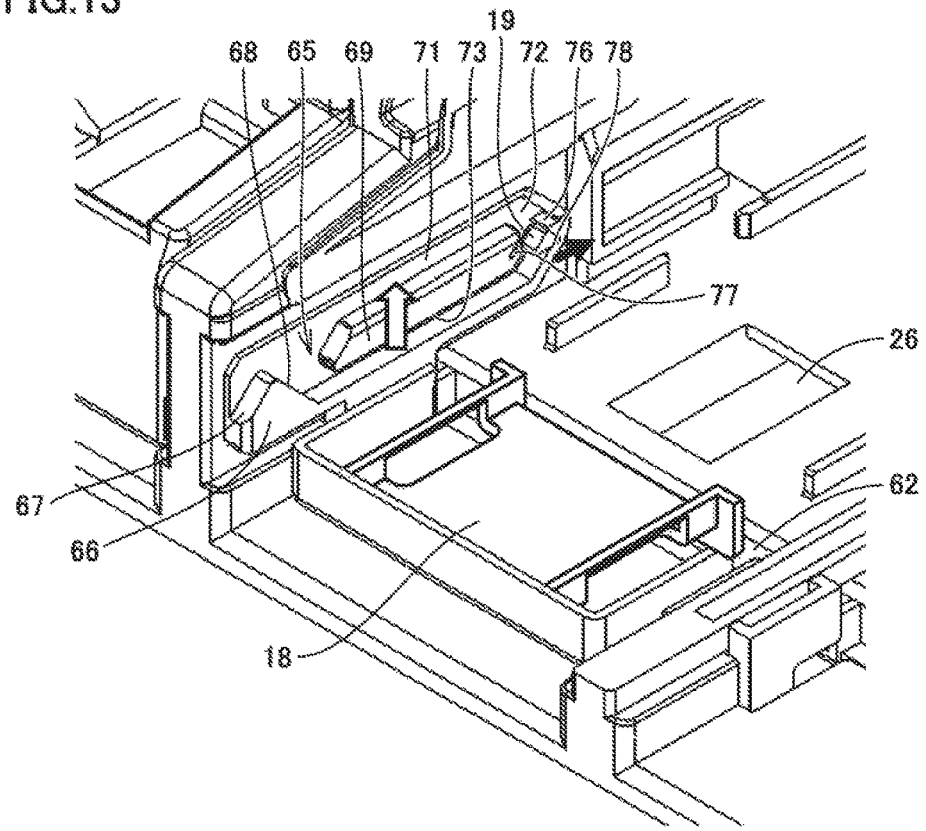
FIG. 13 is a perspective view showing a first step of a detachment operation of detaching the toner cartridge from the device body.
Figure 14:
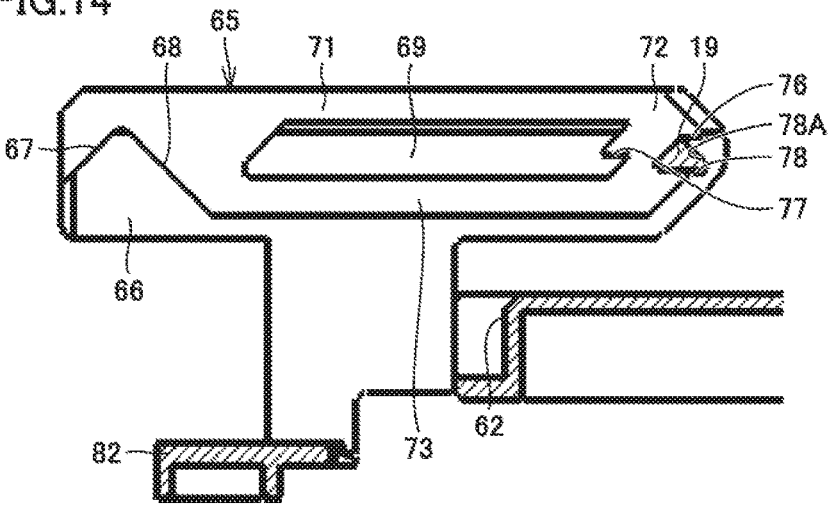
FIG. 14 is a schematic view of the engaging portion and the guiding portion shown in FIG. 13 as viewed laterally.

FIG. 13 is a perspective view showing a first step of the detachment operation of detaching toner cartridge 15 from device body 61. FIG. 14 is a schematic view of engaging portion 19 and guiding portion 65 shown in FIG. 13 as viewed laterally. In the detachment operation of detaching toner cartridge 15 from device body 61, a press operation of pressing toner cartridge 15 into device body 61 from the state shown in FIGS. 11 and 12 in which toner cartridge 15 is locked is performed again. Front inclined surface 19A of engaging portion 19 abuts against a lower inclined surface 78A (FIG. 14). Engaging portion 19 moves along lower inclined surface 78A from lock portion 77 to lower receiving portion 78 to be engaged with lower receiving portion 78. Since lower receiving portion 78 is disposed below lock portion 77, guiding portion 65 moves up as indicated by the open arrow in FIG. 13. Regulating portion 81 moves up together with guiding portion 65.

Figure 15:
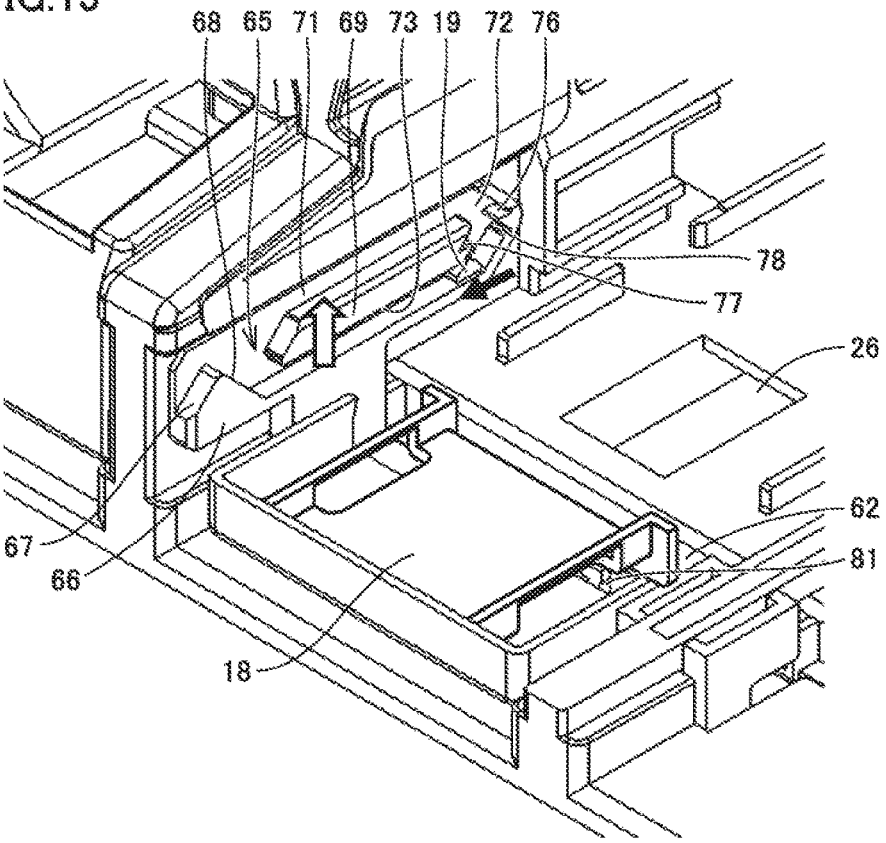
FIG. 15 is a perspective view showing a second step of the detachment operation.
Figure 16:
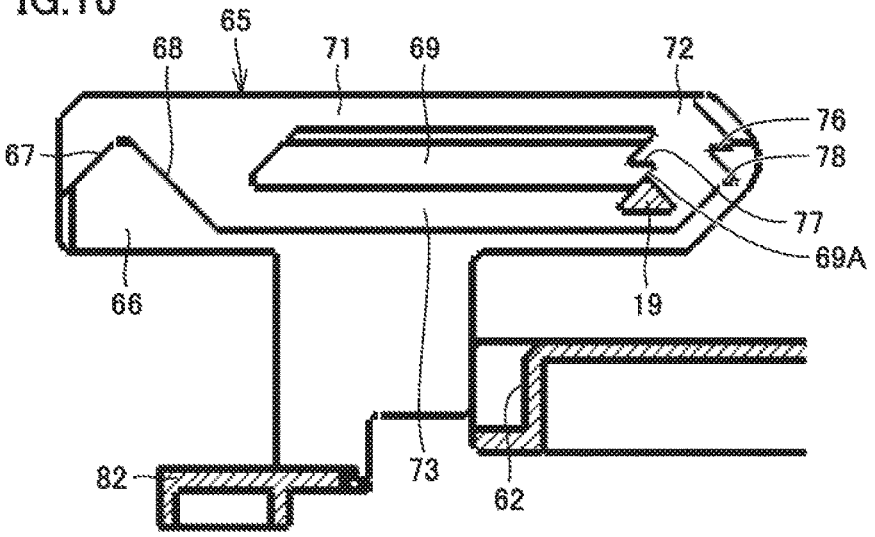
FIG. 16 is a schematic view of the engaging portion and the guiding portion shown in FIG. 15 as viewed laterally.

FIG. 15 is a perspective view showing a second step of the detachment operation. FIG. 16 is a schematic view of engaging portion 19 and guiding portion 65 shown in FIG. 15 as viewed laterally. In the second step of the detachment operation, toner cartridge 15 is pressed by pressing portion 90 from the state shown in FIGS. 13 and 14 in which engaging portion 19 is engaged with lower receiving portion 78, allowing toner cartridge 15 to move toward the front side of device body 61. This movement allows rear inclined surface 19B of engaging portion 19 to abut against a detachment inclined surface 69A (FIG. 16). Engaging portion 19 moves along detachment inclined surface 69A and moves toward lower guide groove 73 as shown in FIGS. 15 and 16.

Since lower guide groove 73 is disposed below Sower receiving portion 78, guiding portion 65 moves up farther as indicated by the open arrow in FIG. 15. Regulating portion 81 moves up further together with guiding portion 65. In the arrangement shown in FIGS. 15 and 16, engaging member 64 has moved to the vicinity of the uppermost portion in the movable range of engaging member 64. At this time, regulating portion 81 projects upward from opening 21 of device body 61. The upper end of regulating portion 81 is disposed above the lower end of shutter 18.

Figure 17:
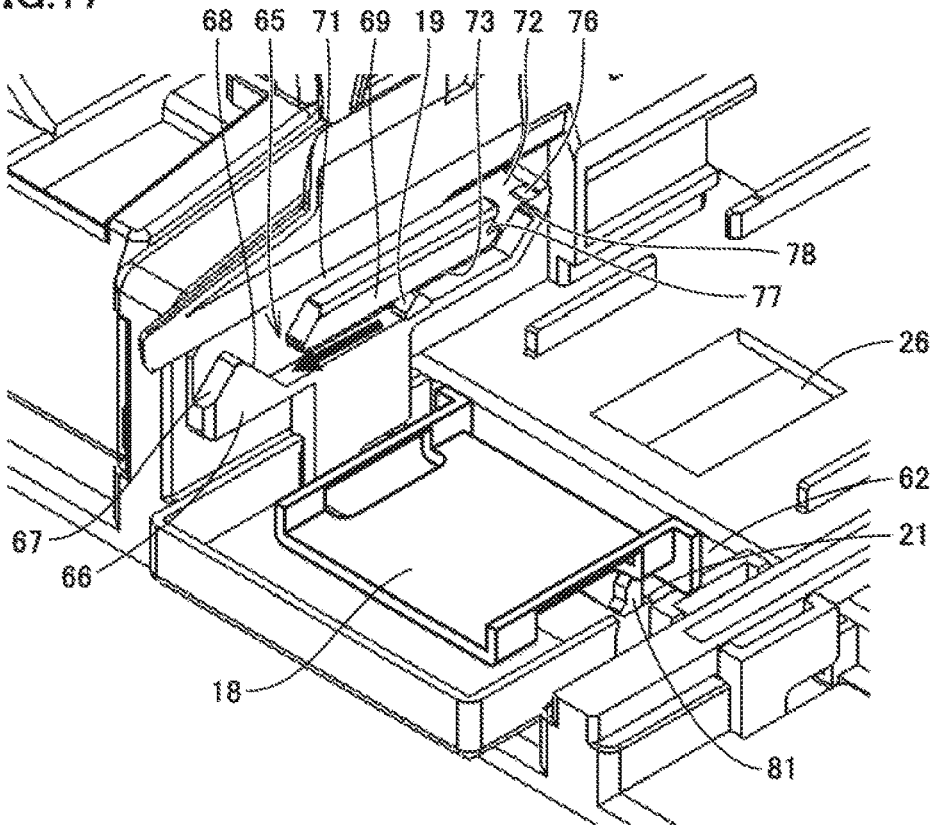
FIG. 17 is a perspective view showing a third step of the detachment operation.
Figure 18:
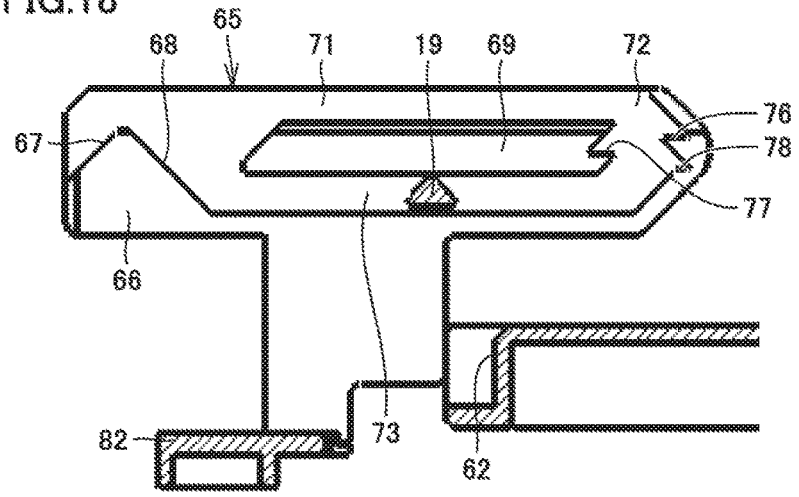
FIG. 18 is a schematic view of the engaging portion and the guiding portion shown in FIG. 17 as viewed laterally.

FIG. 17 is a perspective view showing a third step of the detachment operation. FIG. 18 is a schematic view of engaging portion 19 and guiding portion 65 shown in FIG. 17 as viewed laterally. In the third step of the detachment operation, engaging portion 19 moves toward the front side of device body 61 within lower guide groove 73. Since the relative positions of engaging portion 19 and guiding portion 65 in up-down direction DR2 do not change while engaging portion 19 is moving within lower guide groove 73, engaging member 64 does not move in up-down direction DR2.

As shown in FIG. 17, shutter 18 abuts against regulating portion 81 projecting from opening 21 while engaging portion 19 is moving within lower guide groove 73. When toner cartridge 15 continues moving toward the front side of device body 61 in moving direction DR1, regulating portion 81 regulates the movement of shutter 18. This allows shutter 18 to move with respect to toner supply port 16 formed in toner cartridge 15. Consequently, shutter 18 covers toner supply port 16 to block toner supply port 16.

Figure 19:
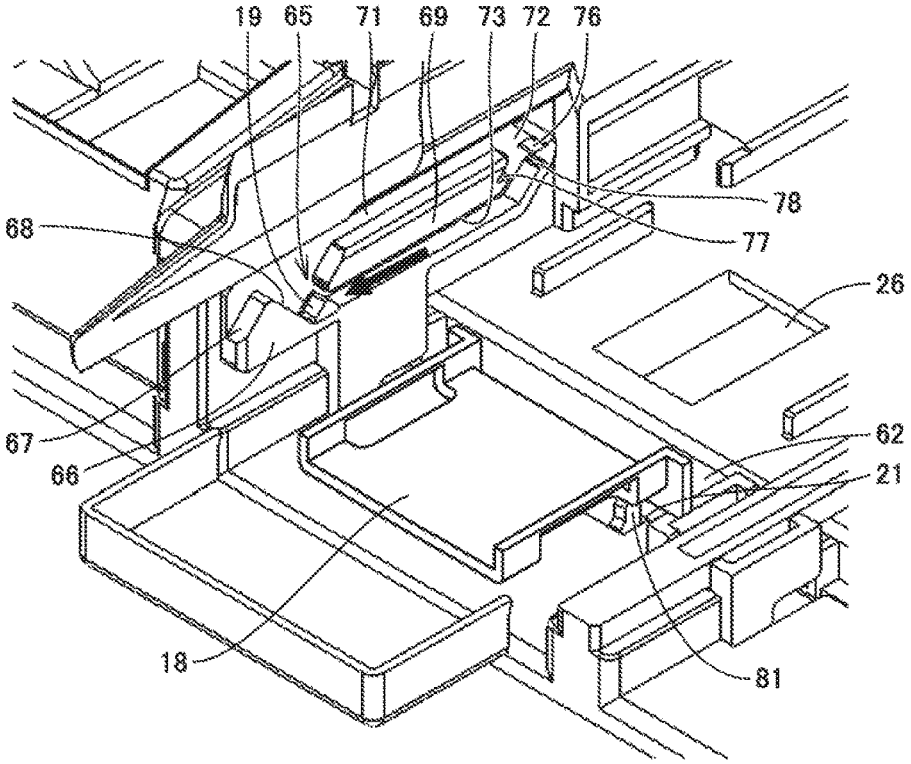
FIG. 19 is a perspective view showing a fourth step of the detachment operation.
Figure 20:
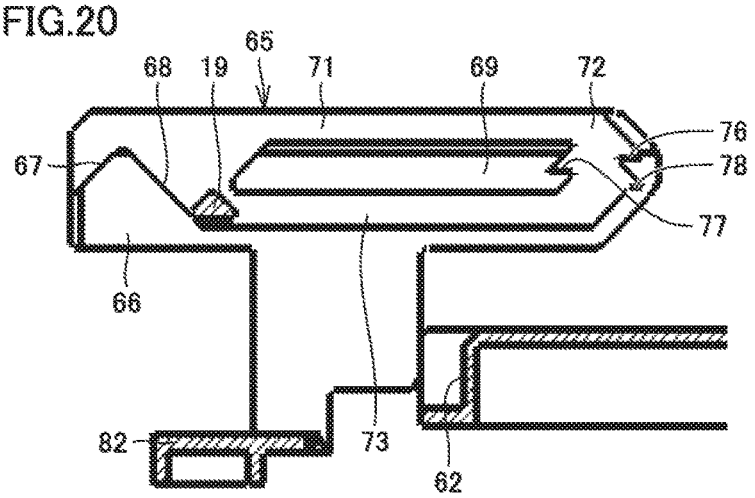
FIG. 20 is a schematic view of the engaging portion and the guiding portion shown in FIG. 19 as viewed laterally.

FIG. 19 is a perspective view showing a fourth step of the detachment operation. FIG. 20 is a schematic view of engaging portion 19 and guiding portion 65 shown in FIG. 19 as viewed laterally. In the fourth step of the detachment operation, as shown in FIGS. 19 and 20, engaging portion 19 reaches entrance/exit inclined portion 66 and abuts against exit inclined surface 68 of entrance/exit inclined portion 66.

Figure 21:
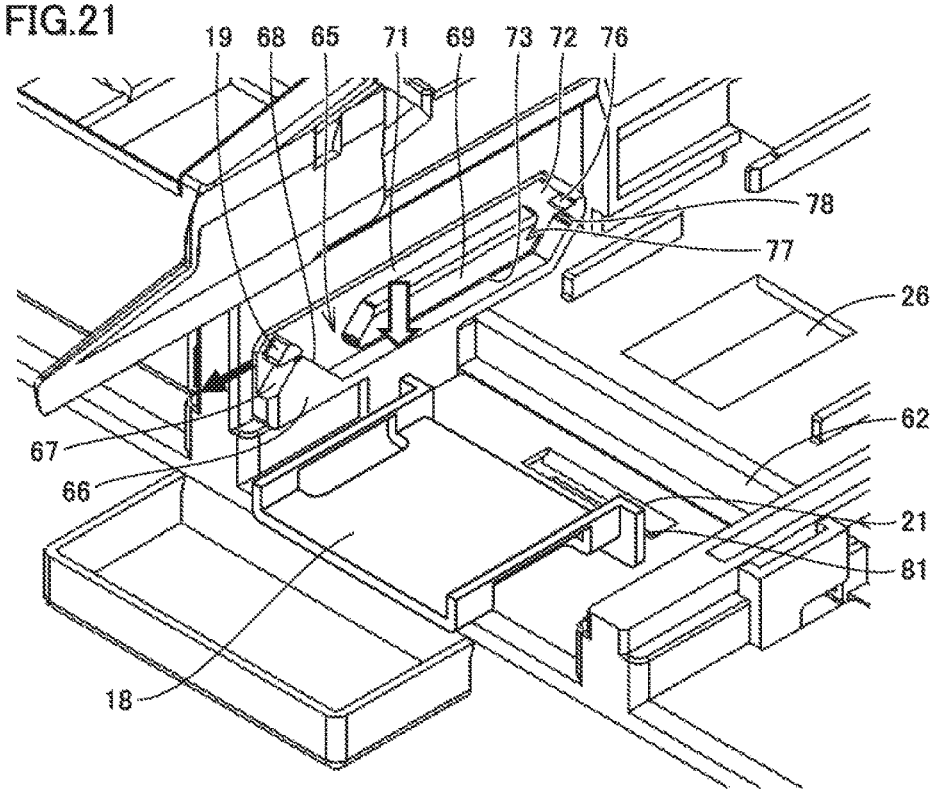
FIG. 21 is a perspective view showing a fifth step of the detachment operation.
Figure 22:
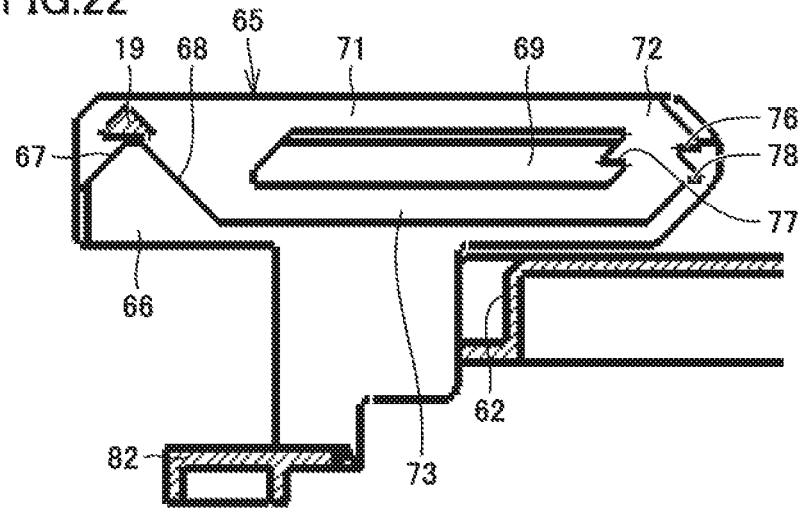
FIG. 22 is a schematic view of the engaging portion and the guiding portion shown in FIG. 21 as viewed laterally.

FIG. 21 is a perspective view showing a fifth step of the detachment operation. FIG. 22 is a schematic view of engaging portion 19 and guiding portion 65 shown in FIG. 21 as viewed laterally. In the fifth step of the detachment operation, engaging portion 19 moves relative to guiding portion 65 along exit inclined surface 68. Guiding portion 65 moves down in accordance with the inclination of exit inclined surface 68 as indicated by the open arrow in FIG. 21. Regulating portion 81 moves down together with guiding portion 65 to be disposed at a retracted position below opening 21. Regulating portion 81 is disposed at such a position as not to interfere with the movement of shutter 18 toward the inner side of device body 61.

After regulating portion 81 has moved to the retracted position, shutter 18 can move together with toner cartridge 15. At this time, shutter 18 is disposed at such a position as to close toner supply port 16 completely.

Engaging portion 19 passes above entrance inclined surface 67 of entrance/exit inclined portion 66 and moves to the outside of device body 61. Then, the entire toner cartridge 15 is detached from device body 61.

[Functions and Effects]

Although partly overlapping the above description, the characteristic configuration and the functions and effects of the present embodiment are summarized as follows.

Toner supply device 60 of the present embodiment includes pressing portion 90 as shown in FIG. 2. Pressing portion 90 presses toner cartridge 15 such that toner cartridge 15 is detached from device body 61. As shown in FIG. 5, guiding portion 65 that guides engaging portion 19 in attaching and detaching toner cartridge 15 to and from the device body has upper guide groove 71 and lock portion 77. Upper guide groove 71 has the function as an attachment path that guides engaging portion 19 in the attachment operation. Lock portion 77 is provided at a position deviated from upper guide groove 71 in innermost portion 72 of guiding portion 65.

As shown in FIGS. 9 to 12, when engaging portion 19 moving in upper guide groove 71 along with the attachment operation reaches innermost portion 72, engaging portion 19 is engaged with lock portion 77 by pressing portion 90 pressing back toner cartridge 15, allowing toner cartridge 15 to be attached to device body 61 so as not to be detached therefrom.

Configuring toner supply device 60 as described above allows toner cartridge 15 to be locked to device body 61 through the operation of pressing toner cartridge 15 into device body 61. Unlike in the conventional technology, there is no member that elastically deforms when toner cartridge 15 is locked. Consequently, an amount of operating force does not increase when a member elastically deforms, or no impact occurs when the elastic deformation is released, allowing for operability which provides a smooth operational feeling and causes no stress to a user.

Engaging portion 19 is disposed to be engaged with lock portion 77 with toner cartridge 15 attached to device body 61, allowing toner cartridge 15 to be positioned in the depth direction of device body 61 (i.e., moving direction DR1 of toner cartridge 15). In this case, toner cartridge 15 and device body 61 are positioned such that toner supply port 16 faces reception opening 26 and toner supply port 16 is positioned above reception opening 26. Consequently, toner can be supplied appropriately from toner cartridge 15 with toner cartridge 15 attached to device body 61.

As shown in FIG. 5, lock portion 77 is disposed below upper guide groove 71. This allows for a relative movement of guiding portion 65 in up-down direction DR2 along with the movement of engaging portion 19 with respect to guiding portion 65.

As shown in FIG. 5, guiding portion 65 further has lower guide groove 73. Lower guide groove 73 has the function as a detachment path that guides engaging portion 19 in the detachment operation. Guiding portion 65 includes upper guide groove 71 and lower guide groove 73 separately, allowing engaging portion 19 to move relative to guiding portion 65 through different guide grooves between in the attachment of toner cartridge 15 and in the detachment of toner cartridge 15.

As shown in FIG. 5, tower guide groove 73 is disposed below lock portion 77. This allows for a relative movement of guiding portion 65 in up-down direction DR2 along with the movement of engaging portion 19 with respect to guiding portion 65. Upper guide groove 71, lock portion 77, and lower guide groove 73 are disposed in the stated order in up-down direction DR2, allowing for a relative movement of guiding portion 65 in one direction, namely, up-down direction DR2, along with the movement of engaging portion 19 when engaging portion 19 moves from upper guide groove 71 via lock portion 77 to lower guide groove 73.

As shown in FIG. 5, guiding portion 65 is provided in engaging member 64 capable of moving up and down relative to toner cartridge 15. This allows guiding portion 65 to move in up-down direction DR2 when engaging portion 19 moves from upper guide groove 71 via lock portion 77 to lower guide groove 73. Consequently, as shown in FIGS. 9 and 11, engaging portion 19 can be engaged with lock portion 77 by engaging member 64 moving up the attachment operation. The configuration in which toner cartridge 15 itself does not move in up-down direction DR2 in the movement of engaging portion 19 relative to guiding portion 65 can prevent interference between toner cartridge 15 and its peripheral member and also prevent a positional shift of toner supply port 16 with respect to reception opening 26.

As shown in FIGS. 13 to 16, the press operation of pressing toner cartridge 15 into device body 61 with engaging portion 19 engaged with lock portion 77 allows engaging portion 19 to be disengaged from lock portion 77, which allows toner cartridge 15 to be detached from device body 61. Consequently, a first press operation allows engaging portion 19 to be engaged with lock portion 77 to lock toner cartridge 15 at such a position as to supply toner in device body 61, and a second press operation unlocks toner cartridge 15. A simple operation of repeating the press operation allows toner cartridge 15 to be locked to and unlocked from device body 61.

As shown in FIG. 4, toner supply device 60 has a pair of engaging portions 19 and a pair of guiding portions 65 in the side portions on the opposite sides of toner cartridge 15. This allows toner cartridge 15 to be positioned in the left-right direction in FIG. 4 when toner cartridge 15 is attached to device body 61. Consequently, positioning of disposing toner supply port 16 to face reception opening 26 can be performed more reliably.

The above embodiment has described a configuration in which engaging member 64 provided in device body 61 has guiding portion 65, upper guide groove 71 and lower guide groove 73 are formed in guiding portion 65, and engaging portion 19 is provided in toner cartridge 15. Since it suffices that engaging portion 19 and guiding portion 65 are provided in pair to toner cartridge 15 and device body 61, a configuration in which engaging portion 19 is provided in device body 61 and toner cartridge 15 has guiding portion 65 may be provided. It suffices that one of toner cartridge 15 and device body 61 has engaging portion 19 and the other has guiding portion 65.

Although image forming apparatus 100 shown in FIG. 1 has four toner cartridges 15 arranged side by side, three or less toner cartridges 15, or five or more toner cartridges 15 may be provided. A plurality of toner cartridges 15 may be arranged in up-down, direction.

Although the above embodiment has described toner cartridge 15 as an example of a replacement part attachable to and detachable from device body 61, the concept of the embodiment may be applied to a replacement part other than toner cartridge 15. For example, the replacement part may be another single unit such as a photoconductor drum, or an imaging cartridge including various parts such as a photoconductor drum, a charging roller, and a toner bottle for use in image formation. Alternatively, the replacement part may be an ink cartridge for an inkjet image forming apparatus.

Although embodiments of the present invention have been described and illustrated in detail, it is clearly understood that the same is by way of illustration and example only and not limitation, the scope of the present invention should be interpreted by terms of the appended claims.

What is claimed is:

1. A toner supply device comprising:

a toner cartridge that contains toner;

a device body that allows the toner cartridge to be attached thereto in a first direction and detached therefrom in a second direction; and a pressing portion that presses the toner cartridge such that the toner cartridge is moved in the second direction, wherein one of the toner cartridge or the device body has an engaging portion, and the other of the toner cartridge or the device body has a guiding portion that guides the engaging portion in an attachment operation of attaching the toner cartridge to the device body and a detachment operation of detaching the toner cartridge from the device body, the guiding portion has an attachment path that extends in a moving direction of the toner cartridge and guides the engaging portion in the attachment operation, and a lock portion provided at a position deviated from the attachment path in an innermost portion of the guiding portion, and when the engaging portion moves in the attachment path during the attachment operation and reaches the innermost portion, the engaging portion is engaged with the lock portion by the pressing portion pressing the toner cartridge in the second direction, allowing the toner cartridge to be attached to the device body so as not to be detached therefrom.

2. The toner supply device according to claim 1, wherein the lock portion is disposed below the attachment path.

3. The toner supply device according to claim 1, wherein the guiding portion further has a detachment path that extends in the moving direction of the toner cartridge and guides the engaging portion in the detachment operation.

4. The toner supply device according to claim 3, wherein the detachment path is disposed below the lock portion.

5. The toner supply device according to claim 1, wherein the other of the toner cartridge or the device body further has an engaging member movable up and down relative to the one of the toner cartridge or the device body, and the guiding portion is provided in the engaging member, and in the attachment operation, the engaging member moves in an up-down direction to cause the engaging portion to be engaged with the lock portion.

6. The toner supply device according to claim 1, wherein a press operation of pressing the toner cartridge into the device body with the engaging portion engaged with the lock portion disengages the engaging portion from the lock portion to allow the toner cartridge to be detached from the device body.

7. The toner supply device according to claim 1, wherein the toner cartridge has, in side portions on opposite sides thereof, a pair of the engaging portions or a pair of the guiding portions.

8. An image forming apparatus comprising:

an image carrier;

a developing device that develops a toner image on the image carrier; and a toner supply device according to claim 1 which supplies toner to the developing device.

* * * * *